US005176298A

United States Patent [19]

Mogler et al.

[11] Patent Number: 5,176,298

[45] Date of Patent: Jan. 5, 1993

[54] TAP HEAD FOR KEG FITTINGS

[75] Inventors: Joachim Mogler, Austrasse 34, Heilbronn, Fed. Rep. of Germany, D-7100; Helmut Wiedmann, Heilbronn, Fed. Rep. of Germany

[73] Assignee: Joachim Mogler, Heilbronn, Fed. Rep. of Germany

[21] Appl. No.: 721,634

[22] PCT Filed: Jan. 10, 1990

[86] PCT No.: PCT/EP90/00051

§ 371 Date: Jul. 11, 1991

§ 102(e) Date: Jul. 11, 1991

[87] PCT Pub. No.: WO90/08728

PCT Pub. Date: Aug. 9, 1990

[30] Foreign Application Priority Data

Jan. 28. 1989 [DE] Fed. Rep. of Germany ..... 3902527

[51] Int. Cl.[5] ..... B65D 83/00

[52] U.S. Cl. ..... 222/400.7; 137/212; 137/322; 141/352; 141/354; 141/357; 222/394; 251/89; 251/319; 251/325

[58] Field of Search ..... 222/394, 400.7, 400.8, 222/401; 137/212, 322; 141/351, 352, 354, 355, 357; 251/89, 319, 324, 325

[56] References Cited

U.S. PATENT DOCUMENTS

| | | | |
|---|---|---|---|
| 3,672,390 | 6/1972 | Gravesteijn | 222/400.7 X |
| 4,125,209 | 11/1978 | Bailey | 222/400.7 |
| 4,181,143 | 1/1980 | Fallon | 137/322 |
| 4,538,746 | 9/1985 | Hines | 222/400.7 X |
| 4,612,952 | 9/1986 | Fallon | 137/212 |
| 4,828,147 | 5/1989 | Wiedmann | 222/400.8 |

FOREIGN PATENT DOCUMENTS

| | | | |
|---|---|---|---|
| 145414 | 11/1982 | Denmark . | |
| 0224380 | 6/1987 | European Pat. Off. . | |
| 2034311 | 1/1971 | Fed. Rep. of Germany . | |
| 2345435 | 3/1974 | Fed. Rep. of Germany . | |
| 2515498 | 10/1975 | Fed. Rep. of Germany . | |
| 7728989 | 9/1976 | Fed. Rep. of Germany . | |
| 7522568 | 11/1978 | Fed. Rep. of Germany . | |
| 2851453 | 5/1979 | Fed. Rep. of Germany . | |
| 7933172 | 1/1981 | Fed. Rep. of Germany . | |
| 3307489 | 9/1984 | Fed. Rep. of Germany . | |
| 3429559 | 2/1986 | Fed. Rep. of Germany . | |
| 3701432 | 7/1987 | Fed. Rep. of Germany . | |
| 2032090 | 11/1970 | France . | |
| 2059613 | 6/1971 | France . | |
| 1450914 | 9/1973 | United Kingdom . | |
| 1553680 | 10/1979 | United Kingdom | 222/400.7 |
| 2158050 | 4/1985 | United Kingdom . | |
| 2176466 | 12/1986 | United Kingdom . | |

*Primary Examiner*—Andres Kashnikow
*Assistant Examiner*—Joseph A. Kaufman
*Attorney, Agent, or Firm*—Shenier & O'Connor

[57] ABSTRACT

A tap head for keg fittings having an actuating lever pivotally mounted on a housing and connected to a slide movable in the housing and detent members positively engaging in one another to lock the actuating lever and with one of the detent members directly biased toward the stop position and in which the detent members are formed of plastic and are made up of an elastically self-biasing tongue cooperating with a detent edge with one of the tongue and detent edge formed integrally on the housing and the other of the tongue and detent edge integrally formed on the actuating lever and with connections for gas and liquid connectable via the slide with corresponding passages in the keg fittings.

22 Claims, 3 Drawing Sheets

FIG.2
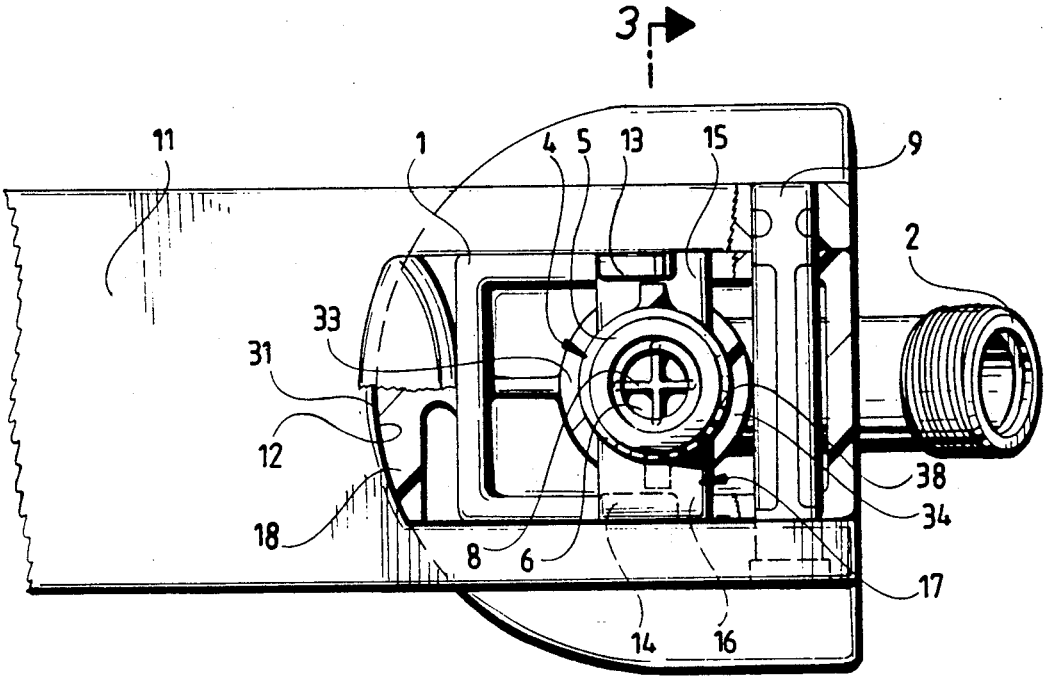
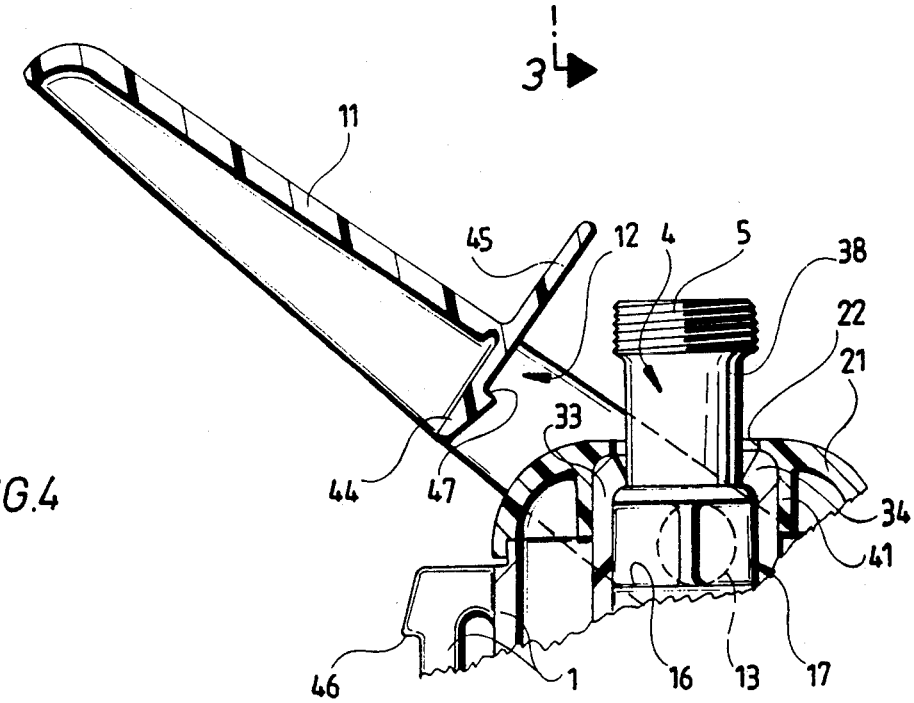
FIG.4

TAP HEAD FOR KEG FITTINGS

FIELD OF THE INVENTION

The invention relates to a tap head for keg fittings.

BACKGROUND OF THE INVENTION

A tap head of this type is known from DE-OS 23 45 435. Similar tap heads are described in GB 21 76 466, DE-GM 77 28 989 and FR 20 32 090.

An essential component of generic tap heads is the slide which is moved by the actuating lever and which has to be locked in place in two different end positions in view of the function of the tap head. Up to now, the slide has been locked in place with the aid of interlocking detent means, of which one, for example in the form of a detent bolt, is biased towards the locked position by a special spring. The construction of the locking means is, therefore, relatively complicated and, consequently, susceptible to breakdown.

The object of the invention is to improve a generic tap head such that it is easy and inexpensive to produce and operates free of trouble over a longer period of time.

Tap heads made of plastic are known in principle from DE-GM 79 33 172 and DE-OS 33 07 489. These are, however, tap heads of a different type which do not require any spring locking means and so the problem underlying the invention is not posed in these publications.

It is also known to use spring snap elements, some of which are made from plastic, in tap devices of a different generic type (DE-GM 75 22 568, DE-OS 34 29 559, DE-OS 20 34 311 and DE-OS 25 15 498). Insofar as the snap elements of these tap devices interact at all with additional parts of the device and not only with drink cans, these are permanent locking devices which, in contrast to the slide of the generic tap head, do not need to be continually released.

BRIEF DESCRIPTION OF THE DRAWINGS

The following description of preferred embodiments of the invention serves to explain the invention in greater detail in conjunction with the attached drawings, in which

FIG. 2 is a part-sectional plan view of the tap head along line 2—2 in FIG. 1;

FIG. 4 is a partial view similar to FIG. 1 of a different embodiment of a tap head and FIGS. 5 and 6 are partial views similar to FIG. 1 of two, again, different embodiments of a tap head.

DESCRIPTION OF THE PREFERRED EMBODIMENT

Figure 1:
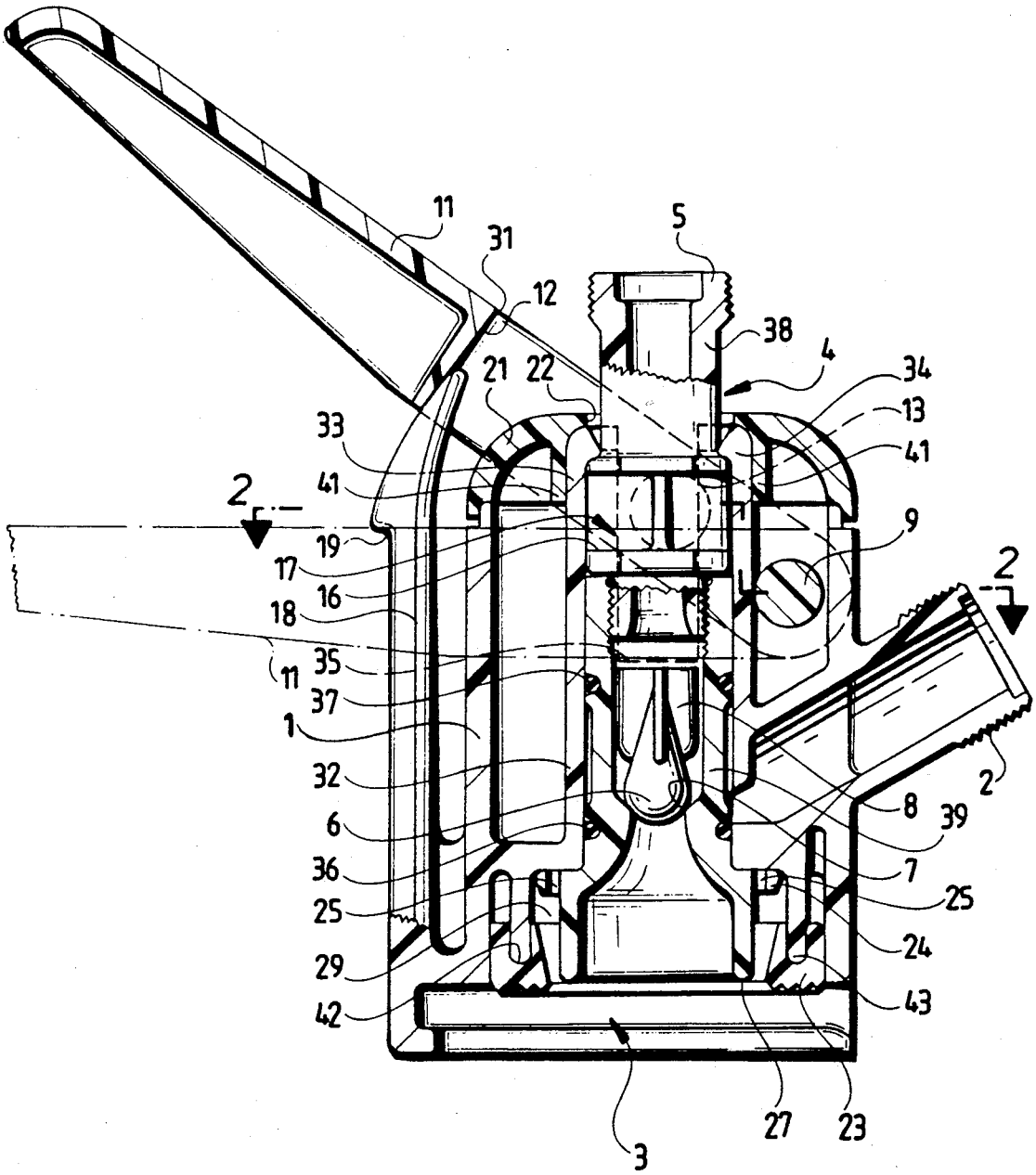
FIG. 1 is a sectional view of a tap head for keg fittings.
Figure 3:
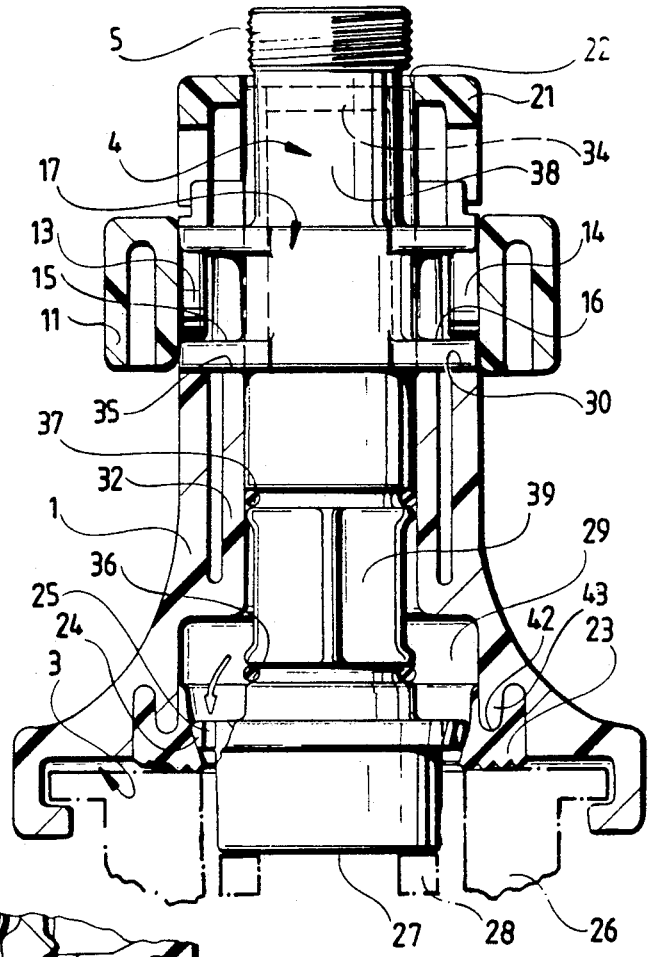
FIG. 3 is a sectional view along line 3—3 in FIG. 2.

The tap head for keg fittings illustrated in FIGS. 1 to 3 essentially consists of the following parts: A housing 1 comprising a pipe connection 2 for introducing pressure gas, e.g. compressed air or $CO_2$, and a sliding guide means 3 which is known per se and is arranged on the underside of the housing 1 for enabling the housing 1 to be pushed in the known manner onto the keg fittings of a barrel, for example a beer barrel, so that tap head and keg fittings are securely connected with one another.

A more or less hollow cylindrical slide 4 is displaceable in the housing 1 in the direction of the longitudinal axis of this housing. The slide 4 extends upwardly as far as a pipe connection 5 for the liquid to be tapped, for example beer. A valve body 6 is loosely arranged in the interior of the slide 4. This valve body interacts with a valve seat 7 on the slide 4 and forms a check valve for the tapped beer. The valve body 6 has, as illustrated, four projecting vanes 8 which effect guidance of the body 6 in the circular-cylindrical hollow chamber of the slide 4. The valve body 6 is freely movable in the slide 4. It could also be biased by a return spring.

An actuating lever 11 is pivotally mounted on the housing 1 by means of a horizontal through bolt 9. The lever has a relatively spacious recess 12 in the region of the housing 1 (cf. FIG. 2), with which it encircles the upper portion of the housing such that it is pivotable from the upper position illustrated by a solid line in FIG. 1 into a lower position illustrated by a dash-dot line. In the region of the recess 12 two pins 13, 14 project inwardly from the actuating lever 11 and engage in recesses 15 and 16, respectively, of a crossarm 17 integrally formed on the slide 4. When the actuating lever is pivoted between its two positions illustrated in FIG. 1, the slide 4 moves with it. The upper position is the open position of the tap head, the lower position the closed position. In the open position, the tap head can be removed from the keg fittings or connected therewith. In the closed position, the pipe connections 2, 5 are connected with corresponding passages in the keg fittings for gas or liquid.

A spring tongue 18 is integrally formed on the housing 1. This tongue projects freely upwards and comprises a detent edge 19 in its upper region. As illustrated, the upper end of the spring tongue constantly engages in the recess 12 of the actuating lever 11. When the actuating lever is moved from its upper into its lower position, the spring tongue 18 will be elastically biased until its detent edge 19 is located above the upper side of the actuating lever 11. This detent edge then protrudes above the edge of the recess 12 (FIG. 2) and the actuating lever 11 is hereby locked in its lower position.

Finally, a housing lid 21 is provided which closes the housing 1 at the top and has an upper opening 22 for passage of the pipe connection 5 on the slide 4. An annular seal 23 is provided inside in the interior of the housing 1 and seals the housing relative to the keg fittings.

FIG. 3 shows the tap head with the actuating lever 11 in its lower position, in which the tap head is connected with the keg fittings so as to be liquid and gas tight. In this position, an annular collar 24 with gas passages 25, which is integrally formed in the lower region of the slide 4, engages on the inner flank of the annular seal 23 and presses this in the manner shown in FIG. 3 sealingly against an associated part 26 of the keg fittings which are indicated in FIG. 3 and known per se. At the same time, the lower edge 27 of the opening of the downwardly guided slide 4 has, in a manner known per se, pushed a part 28 of the keg fittings, which is shown schematically in FIG. 3 as a dash-dot line, downwardly and hereby opens the passage for the liquid. Pressure gas can enter the chamber 29 (FIG. 3) through the pipe connection 2 and from there can enter the barrel provided with the keg fittings via the passages 25. The gas is passed to the region above the level of the liquid and from here it presses the liquid, e.g. beer, via a piercing member rigidly arranged in the barrel into the slide 4 connected with the part 28 and, from there, via the pipe connection 5 and a tube provided thereon to a tap.

When the actuating lever 11 is intended to be brought from its lower, locked position into the upper position, the spring tongue 18 is pressed, for example with the thumb, such that the detent edge 19 reaches into the region of the recess 12 and the actuating lever 11 can then be pivoted upwardly without hindrance.

The housing 1, the slide 4, the actuating lever 11 and the spring tongue 18 used as locking means consist of plastic. Plastic materials having good relative anti-friction properties, for example polyacetal resins having different hardnesses, are preferably used for the housing 1 and the slide 4. These materials can also comprise an anti-friction agent, for example Teflon which is the registered trademark of E. I. du Pont de Nemour & Co. for polytetrafluoroethylene. Plastic materials which are compatible with foods are used for the tapping of beers and other beverages.

It is important that the spring tongue 18, which serves as locking means and interacts with the actuating lever 11, is integrally formed on the housing. In this way, the production and maintenance of the tap head is simple. The edge 31 on the recess 12 of the actuating lever 11, which interacts with the spring tongue 18 and its detent edge 19 and is also formed as a detent edge, is, of course, integrally formed on this actuating lever.

As shown in the drawings, the housing 1 consists of an outer housing portion and an inner housing portion. The inner housing portion serves as a sliding guide means for the slide 4. The inner housing portion is designed in the lower region of the slide 4 facing the keg fittings as a closed guide cylinder 32. Two resilient arms 33, 34 project upwardly from this guide cylinder 32 and guide the upper region of the slide 4. The arms 33, 34 are, together with the guide cylinder 32, again integral parts of the housing 1.

As illustrated in FIG. 1, the resilient arms 33, 34 form with their angled end portions an upper stop for the slide 4 such that the path of displacement of the slide is limited in the upward direction. As illustrated, the bent-over ends of the arms 33, 34 engage, in this position, on the crossarm 17 integral with the slide 4.

The upper edge 35 of the guide cylinder 32 forms a lower stop for the crossarm 17 on the slide 4 so that the path of displacement of the slide is limited hereby in the downward direction. As shown in FIG. 3, the crossarm 17 of the slide 4, in its lower end position, also butts on an upper edge 30 of the housing 1.

Sealing rings 36, 37 serve to seal the slide 4 in the guide cylinder 32.

The slide 4 consists, as also best shown in FIG. 1, of two parts, namely an upper part 38 (in FIG. 1 section lined from bottom left to top right) connected with the actuating lever 11 and a lower part 39 (in FIG. 1 section lined from top left to bottom right) which can be pressed onto the keg fittings (cf. reference numerals 26 and 28 in FIG. 3) and which slides in the guide cylinder 32. The upper part 38 of the slide 4 is substantially arranged between the two spring arms 33, 34. The upper part 38 is, as illustrated, screwed to the lower part 39. Before these parts are screwed together, the valve body 6 is inserted into the lower part 39, in which it is captively held once the upper part has been screwed on. The valve body 6 also consists of plastic.

The slide consisting of the two parts 38, 39 is inserted as follows into the housing 1. The upper part is introduced between the spring arms 33, 34 from above, the lower part 39 is inserted from below into the guide cylinder 32 once the valve body 6 has already been inserted therein. Subsequently, the two parts 38, 39 are screwed together, e.g. by turning the lower part 39. Subsequently, the housing lid 21 is placed on the housing 1 and securely connected thereto. As illustrated, the lid 21 has on its inner side projections 41 which abut securely on the spring arms 33, 34 when the lid is attached and hold these arms together in this way so that, on the one hand, the upper part 38 of the slide 4 is guided and, on the other hand, the path of displacement of the slide 4 is limited by the upper, curved end sections of the arms 33, 34.

Due to the screw connection between upper part 38 and lower part 39 these parts can easily be released from one another and, if necessary, exchanged. Instead of the screw connection, the parts 38, 39 could also be connected with one another by a bayonet catch or the like so as to be exchangeable.

The sealing ring 23 already mentioned, on the underside of the housing 1, consists of elastic material and can be deformed by the lower annular collar 24 of the slide 4 (FIG. 3), once the tap head has been placed on the keg fittings, so that an effective seal is provided. The elastic sealing ring 23 has an axially extending, annular recess 42, with which it is positively fitted onto a complementary, annular projection 43 in the interior of the housing 1, which is also axially extending. It has been found that a particularly good sealing effect can be achieved with the aid of the sealing ring 23 held in this manner and the lower part 39 of the slide 4 acting on this sealing ring.

In the modified embodiment of the invention illustrated in FIG. 4, a spring tongue is not arranged on the housing 1 but on the actuating lever 11. The spring tongue designated in FIG. 4 by reference numeral 44 has an upwardly projecting, relatively short arm 45 beyond its point of connection with the actuating lever 11. An edge 47 of the spring tongue 44 interacts with a detent edge 46 integrally formed on the housing 1 when the actuating lever 11 is moved from its upper position into the lower operative position, and hereby holds the lever 11 in this lower position. By pressing on the arm 45 the detent tongue 44 can be pivoted and released from the detent edge 46 so that the actuating lever can be returned again to its upper position. In this case, as well, the locking means formed by the spring tongue 44 and the associated detent edge 46 are again integrally formed on the housing 1 and on the actuating lever 11.

Figure 5:
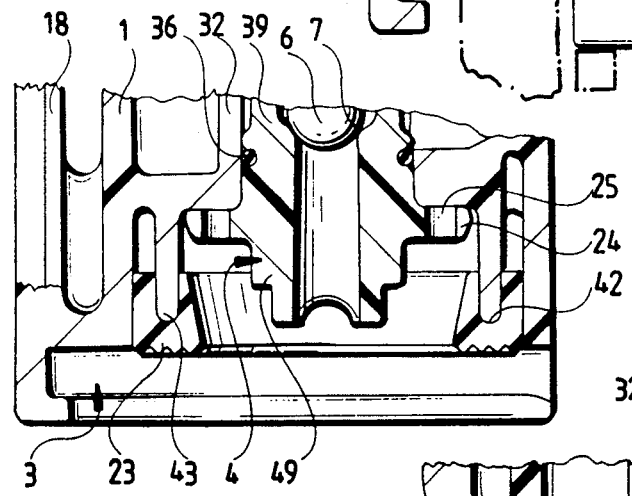
Figure 6:
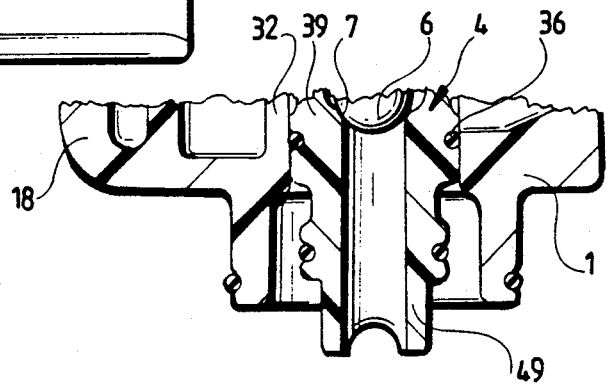

The tap head illustrated in FIGS. 1 to 3 is a so-called "flat fitting" due to the sliding guide means 3, with which it is secured to the keg fittings. The tap heads partially illustrated in FIGS. 5 and 6 correspond exactly in their upper parts to the tap heads according to FIGS. 1 to 3 or 4. They differ herefrom merely due to the type of connection of the tap head with the keg fittings. FIG. 5 illustrates a tap head with a so-called "combined fitting" which differs from the "flat fitting" of FIGS. 1 to 3 only in that the lower part 49 of the slide 4 is of a different design for the purpose of engaging on a different, conventional type of keg fitting. The tap head illustrated in FIG. 6 is not connected to the keg fittings by a sliding guide means but (in a manner known per se) by a type of bajonet catch ("basket fitting"), the lower part 49 of the slide 4 again being designed in accordance with the lower part 49 from FIG. 5. Otherwise, the tap head of FIG. 6 corresponds exactly to that of FIGS. 1 to 3 or 4.

The division of the slide 4 into the two parts 38 and 39 releasably connected with one another has the advantage that different lower parts 39 can be optionally attached to a single upper part 38 according to the type of fitting used, i.e. a basket, flat or combined fitting.

We claim:

1. Tap head for keg fittings comprising a housing, a slide movable in the housing, an actuating lever pivotally mounted on the housing and connected to the slide, said actuating lever being pivotable between an upper and a lower position, releasable locking means for the actuating lever designed as detent members engaging positively in one another, and connections for gas and liquid connectable via the slide with corresponding passages in the keg fittings, characterized in A. that the housing (1), the slide (4), the actuating lever (11) and the locking means consist of plastic, B. that the actuating lever (11) has a recess (12) in the region of the housing (1), with which it encircles the upper portion of the housing, C. that the locking means comprise a spring tongue (44) elastically biased in the direction towards a locking position corresponding to the lower position of the actuating lever, D. that the spring tongue (44) is formed integrally on the actuating lever (11) and comprises a first detent edge (47) on its free end and an upwardly projecting arm (45) beyond its point of connection with the actuating lever, E. and that a second detent edge (46) interacting with the first detent edge (47) is integrally formed on the housing (1), so that the actuating lever (11) is locked by said first and second detent edges (46, 47) in its lower position and may be returned in its upper position by pressing on said arm (45) of the spring tongue (44), releasing thereby the first detent edge (47) from the second detent edge (46).

2. Tap head as defined in claim 1, characterized in that a check valve body (6) made of plastic is captively arranged in the slide (4).

3. Tap head as defined in claim 2, characterized in that the check valve body (6) is spring loaded.

4. Tap head as defined in claim 1, characterized in that the slide (4) consists of two parts, namely an upper part (38) connected to the actuating lever (11) and a lower part (39) adapted to be pressed onto the keg fittings.

5. Tap head as defined in claim 4, characterized in that upper part (38) and lower part (39) are connected with one another so as to be exchangeable.

6. Tap head as defined in claim 1, characterized in that the housing (1) has a guide cylinder (32) for the lower region of the slide (4) facing the keg fittings and upwardly resilient arms (33, 34) project from this guide cylinder, these arms guiding the upper region of the slide (4).

7. Tap head as defined in claim 6, characterized in that the arms (33, 34) form an upper stop for the slide (4) and are fixed by a lid (21) connected to the housing (1).

8. Tap head as defined in claim 6, characterized in that the upper edge (35) of the guide cylinder (32) forms a lower stop for the slide (4).

9. Tap head as defined in claim 1, characterized in that an elastic sealing ring (23) cooperating with the keg fittings and deformable by the axially displaceable slide (4) is arranged in the housing (1), and the sealing ring (23) is positively connected with the housing (1) by axially extending, complementary recesses (42) and projections (43).

10. Tap head as defined in claim 1, characterized in that slide (4) and housing (1) consist of polyacetal resins.

11. Tap head as defined in claim 1, characterized in that an upper edge (30) of the housing (1) forms a lower stop for the slide (4).

12. Tap head for keg fittings comprising a housing, a slide movable in the housing, an actuating lever pivotally mounted on the housing and connected to the slide, said actuating lever being pivotable between an upper and a lower position, releasable locking means for the actuating lever designed as detent members engaging positively in one another, and connections for gas and liquid connectable via the slide with corresponding passages in the key fittings, characterized in A. that the housing (1), the slide (4), the actuating lever (11) and the locking means consist of plastic, B. that the actuating lever (11) has a recess (12) in the region of the housing (1), with which it encircles the upper portion of the housing, said recess having a first detent edge (31), C. that the locking means comprise a spring torque (18) elastically biased in the direction towards a locking position corresponding to the lower position of the actuating lever, D. that the spring tongue (18) projects freely upwards and comprises a second detent edge (19) in its upper end, E. and that the elastically biased spring tongue (18) is formed integrally on the housing (1), said upper end of the spring tongue constantly engaging in the recess of the actuating lever, so that when moving the actuating lever from its upper into its lower position the spring tongue (18) will be elastically biased until the second detent edge (19) is located above the upper side of the actuating lever (11) and protrudes above the first detent edge (31) of the recess (12), locking thereby the actuating lever in its lower position.

13. Tap head as defined in claim 12, characterized in that a check valve body (6) made of plastic is captively arranged in the slide (4).

14. Tap head as defined in claim 13, characterized in that the check valve body (6) is spring loaded.

15. Tap head as defined in claim 12, characterized in that the slide (4) consists of two parts, namely an upper part (38) connected to the actuating lever (11) and a lower part (39) adapted to be pressed onto the keg fittings.

16. Tap head as defined in claim 15, characterized in that upper part (38) and lower part (39) are connected with one another so as to be exchangeable.

17. Tap head as defined in claim 12, characterized in that the housing (1) has a guide cylinder (32) for the lower region of the slide (4) facing the keg fittings and upwardly resilient arms (33, 34) project from this guide cylinder, these arms guiding the upper region of the slide (4).

18. Tap head as defined in claim 17, characterized in that the arms (33, 34) form an upper stop for the slide (4) and are fixed by a lid (21) connected to the housing (1).

19. Tap head as defined in claim 17, characterized in that the upper edge (35) of the guide cylinder (32) forms a lower stop for the slide (4).

20. Tap head as defined in claim 12, characterized in that an elastic sealing ring (23) cooperating with the keg fittings and deformable by the axially displaceable slide (4) is arranged in the housing (1), and the sealing ring (23) is positively connected with the housing (1) by axially extending, complementary recesses (42) and projections (43).

21. Tap head as defined in claim 12, characterized in that slide (4) and housing (1) consist of polyacetal resins.

22. Tap head as defined in claim 12, characterized in that an upper edge (30) of the housing (1), forms a lower stop for the slide (4).

* * * * *

UNITED STATES PATENT AND TRADEMARK OFFICE

CERTIFICATE OF CORRECTION

PATENT NO. : 5,176,298

DATED : January 5, 1993

INVENTOR(S) : Joachim Mogler, Helmut Wiedmann

It is certified that error appears in the above-identified patent and that said Letters Patent is hereby corrected as shown below:

Column 6, line 16 - "key" should read -- keg --.

Column 6, line 23 - "torque" should read -- tongue --.

Signed and Sealed this

Twenty-third Day of November, 1993

*Attest:*

Bruce Lehman

BRUCE LEHMAN

*Attesting Officer*

*Commissioner of Patents and Trademarks*